US006786795B1

(12) United States Patent
Mullaney et al.

(10) Patent No.: US 6,786,795 B1
(45) Date of Patent: Sep. 7, 2004

(54) REMOTE-CONTROLLED TRACTOR TRAILER TOY

(75) Inventors: Sean Mullaney, Cincinnati, OH (US); Michael Hoeting, Cincinnati, OH (US); Neil Hamilton, Ft. Mitchell, NY (US); Steven Fink, Cincinnati, OH (US); Tommie Lucas, Cincinnati, OH (US); Robert Paul Spalinski, Titusville, NJ (US); Matthew James Del Duke, Audubon, NJ (US)

(73) Assignee: Bang Zoom Design Ltd., Cincinnati, OH (US)

( * ) Notice: Subject to any disclaimer, the term of this patent is extended or adjusted under 35 U.S.C. 154(b) by 45 days.

(21) Appl. No.: 10/068,973

(22) Filed: Feb. 7, 2002

(51) Int. Cl.[7] ..... A63H 17/00

(52) U.S. Cl. ..... 446/431; 446/434; 446/465

(58) Field of Search ..... 446/431, 434, 446/465, 468, 470, 93, 95

(56) References Cited

U.S. PATENT DOCUMENTS

| | | | | | |
|---|---|---|---|---|---|
| 10,114 | A | | 5/1882 | Reed | |
| 2,595,936 | A | * | 5/1952 | Goode, Jr. | 105/75 |
| 3,659,666 | A | | 5/1972 | Forsyth et al. | |
| 3,717,215 | A | | 2/1973 | Nigg et al. | |
| 3,747,265 | A | * | 7/1973 | Gagnon | |
| 3,775,902 | A | * | 12/1973 | Gagnon | |
| 3,831,832 | A | | 8/1974 | Gray | |
| D244,475 | S | * | 5/1977 | Asano | |
| D252,230 | S | * | 6/1979 | Asano | D21/132 |
| 4,270,305 | A | * | 6/1981 | Samuels | 446/95 |
| 4,657,520 | A | | 4/1987 | Sheffer | |
| 4,698,042 | A | | 10/1987 | Rubin | |
| 4,698,044 | A | | 10/1987 | Kennedy et al. | |
| 4,713,012 | A | | 12/1987 | Poplawski et al. | |
| 4,718,875 | A | | 1/1988 | McKittrick et al. | |
| 4,757,871 | A | | 7/1988 | Steimer | |
| 4,869,700 | A | | 9/1989 | Reiling, Jr. et al. | |
| 5,052,680 | A | * | 10/1991 | Malewicki et al. | 272/1 R |
| 5,338,247 | A | | 8/1994 | Miles | |
| 5,441,149 | A | | 8/1995 | Willard et al. | |
| D371,959 | S | | 7/1996 | Hupp | |
| 5,609,510 | A | | 3/1997 | Stubenfoll et al. | |
| 5,762,533 | A | | 6/1998 | Tilbor et al. | |
| 6,110,003 | A | | 8/2000 | Green | |
| 6,129,607 | A | | 10/2000 | Hoeting et al. | |
| D466,167 | S | * | 11/2002 | Mullaney et al. | D21/558 |

* cited by examiner

*Primary Examiner*—Derris H. Banks
*Assistant Examiner*—Ali Abdelwahed
(74) *Attorney, Agent, or Firm*—Akin Gump Strauss Hauer & Feld, L.L.P.

(57) ABSTRACT

A toy vehicle has a tractor and trailer that is countable to the tractor. The tractor includes a tractor hitch assembly and an operating assembly for propelling the tractor in forward and reverse directions and for turning the tractor 360° in place. The trailer has a trailer body and a tongue extending therefrom with a trailer hitch assembly connected to the trailer tongue. The tractor and trailer hitch assemblies are arranged and countable together to enable relative pitch and roll between the tractor and trailer and rotation of the tractor under the trailer tongue at least on a flat surface.

22 Claims, 14 Drawing Sheets

REMOTE-CONTROLLED TRACTOR TRAILER TOY

BACKGROUND OF THE INVENTION

This invention relates to toy vehicles, and more particularly to a remote-controlled tractor trailer toy having unusual action capabilities.

Remotely controlled toy vehicles have come to constitute a significant specialty toy market. Toy manufacturers attempt to duplicate well known vehicles, as well as the latest in automotive developments, including specialty entertainment vehicles. In addition, manufacturers constantly seek new ways and features to add innovative action to such toy vehicles to make them more versatile and/or entertaining.

By way of example, U.S. Pat. No. 4,698,044 issued to Kennedy et al. on Oct. 6, 1987, discloses an articulated toy vehicle having a motorized tractor section and a series of trailer sections linked together through a multi-segmented drive shaft. The multi-segmented drive shaft has an articulated joint between the tractor section and trailer section and between each subsequent trailer section. The articulated joint includes a ball with diametrically opposed pins on one drive shaft segment and a socket with diametrically opposed slots for receiving the ball and pins, respectively, on a subsequent drive shaft segment. In this manner, the toy vehicle can supply power to the wheels of the tractor section and each trailer section while adapting to varying terrain conditions.

BRIEF SUMMARY OF THE INVENTION

According to one aspect of the invention, a toy vehicle comprises a tractor and a trailer. The tractor has a tractor body with an operating assembly configured to at least steer the tractor from a forward facing position to an opposite rearward facing position, and a tractor hitch assembly connected to at least one of the operating assembly and the body. The trailer has a trailer body and a tongue extending therefrom, and a trailer hitch assembly connected to the trailer tongue, and is countable with the tractor hitch assembly. The tractor and trailer are configured such that the tractor can steer from the forward facing position to the opposite rearward facing position and be longitudinally aligned under the trailer tongue at least essentially without interference with the trailer.

According to a further aspect of the invention, an articulated toy vehicle comprises a first vehicle portion having a first hitch connected thereto and a second vehicle portion having a second hitch connected thereto. The first hitch comprises a generally spherical base member, a first connector member extending from the base member, and a housing connected to the first vehicle portion. The housing has a generally spherical socket for receiving the base member and an opening through which the first connector member extends for coupling with the second hitch assembly.

According to an even further aspect of the invention, an articulated toy vehicle comprising a first vehicle portion having a plurality of road wheels; a second vehicle portion having a plurality of road wheels; and an articulated coupling between the first vehicle portion and the second vehicle portion; the first and second vehicle portions and the articulated coupling being configured and positioned such that the first vehicle portion can be rotated at least 360° around the articulated coupling and completely beneath the second vehicle portion at least essentially without interference between the first and second vehicle portions with all of the road wheels of the first and second vehicle portions supported by a level surface beneath the toy vehicle.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 3:
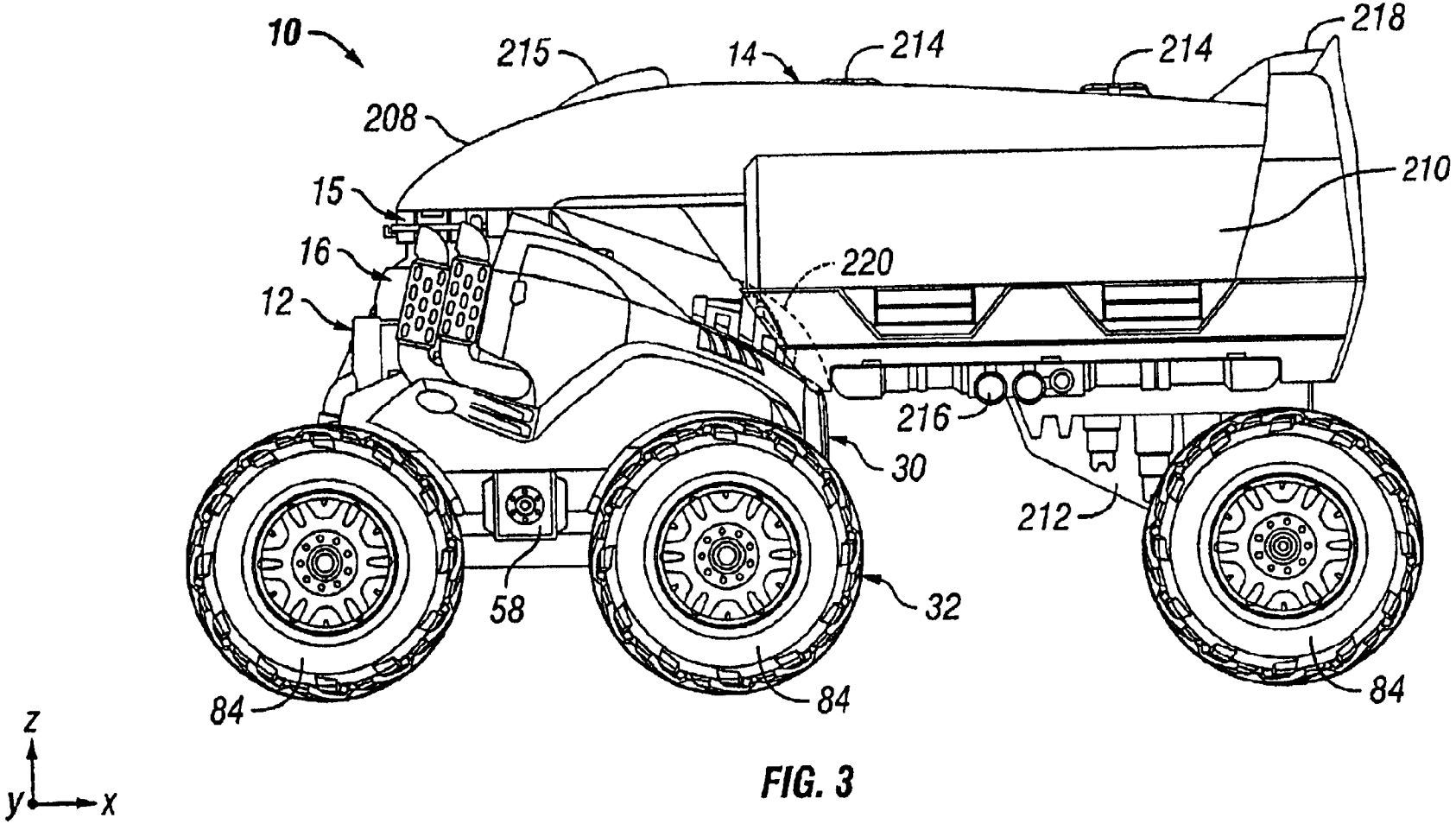
FIG. 3 is a side elevational view of the toy tractor and trailer with the tractor rotated so as to be longitudinally aligned with the trailer directly under the trailer.
Figure 4:
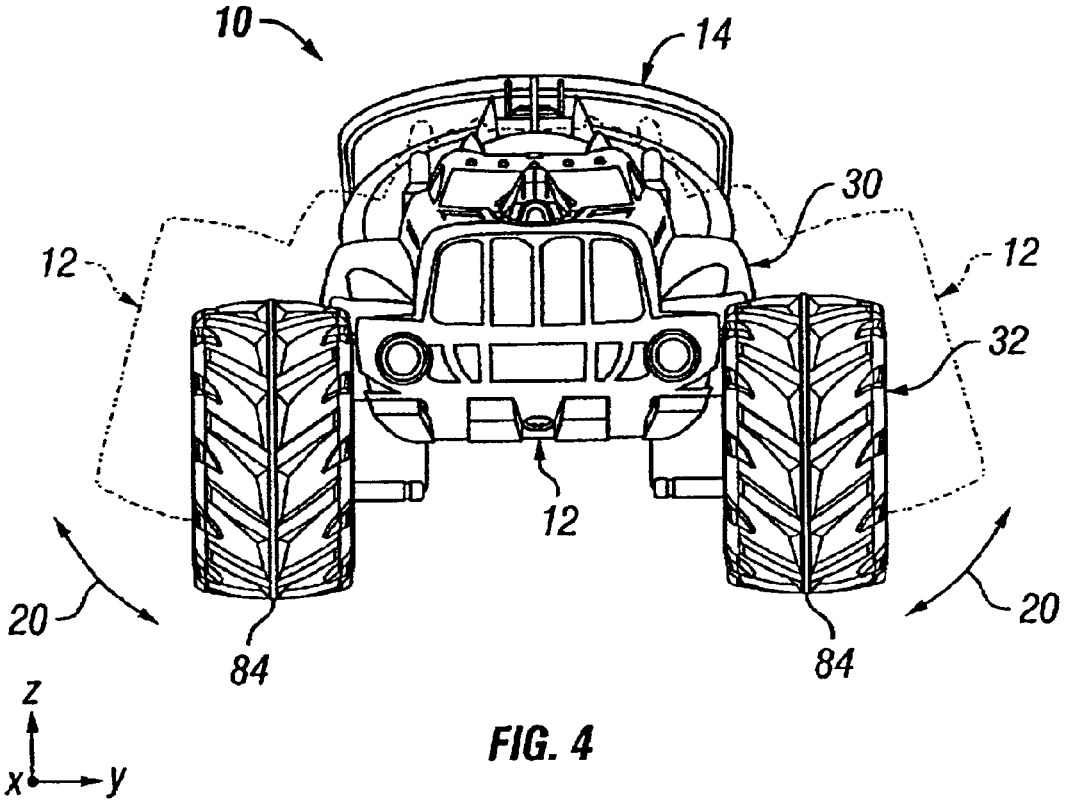
FIG. 4 is a front elevational view of the tractor trailer toy and illustrating relative tilt between the tractor and trailer about a longitudinal or X-axis.
Figure 5:
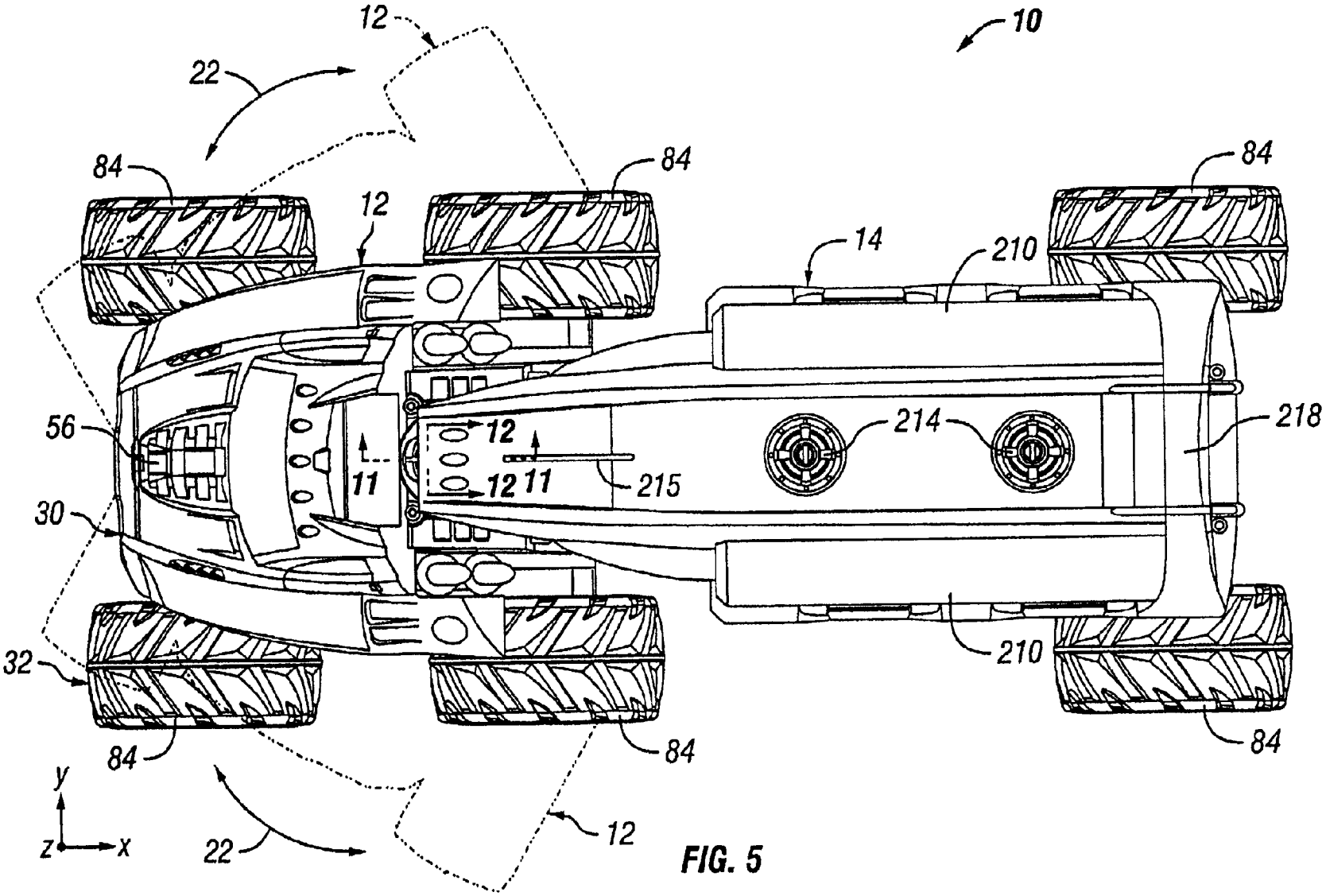
FIG. 5 is a top plan view of the tractor trailer toy and illustrating rotation of the tractor with respect to the trailer about a vertical or Z-axis.

It will be understood that the particular orientation of X-, Y- and Z-axes, as well as other terms of orientation and/or position as may be used throughout the specification such as front, rear, forward, rearward, upper, lower, and their respective derivatives, refer to relative, rather than absolute orientations and/or positions Referring now to the drawings, and to FIGS. 1–5 in particular, a remote controlled tractor trailer toy 10 according to an exemplary embodiment of the present invention is illustrated. The remote controlled tractor trailer toy 10 comprises a tractor 12 and a trailer 14 that are rotatably and pivotally connected together through a trailer hitch assembly 15 and a tractor hitch assembly 16, as will be described in greater detail below. Preferably, the hitch assemblies 15, 16 are arranged and located, and the tractor 12 and trailer 14 being configured by being sized, shaped and located such that the tractor 12 can pitch about a Y-axis, as shown by arrows 18 in FIG. 2, roll about an X-axis, as shown by arrows 20 in FIG. 4, steer and preferably rotate 360° about a Z-axis as shown by arrows 22 in FIG. 5, as well as various combinations of pitch, roll and rotation. As shown in FIG. 3, the tractor 12 is preferably capable of rotating completely around the articulated coupling formed by the hitch assemblies 15, 16 and directly under the trailer 14 longitudinally aligned with the trailer, without any interference between the tractor and trailer 14.

Figure 1:
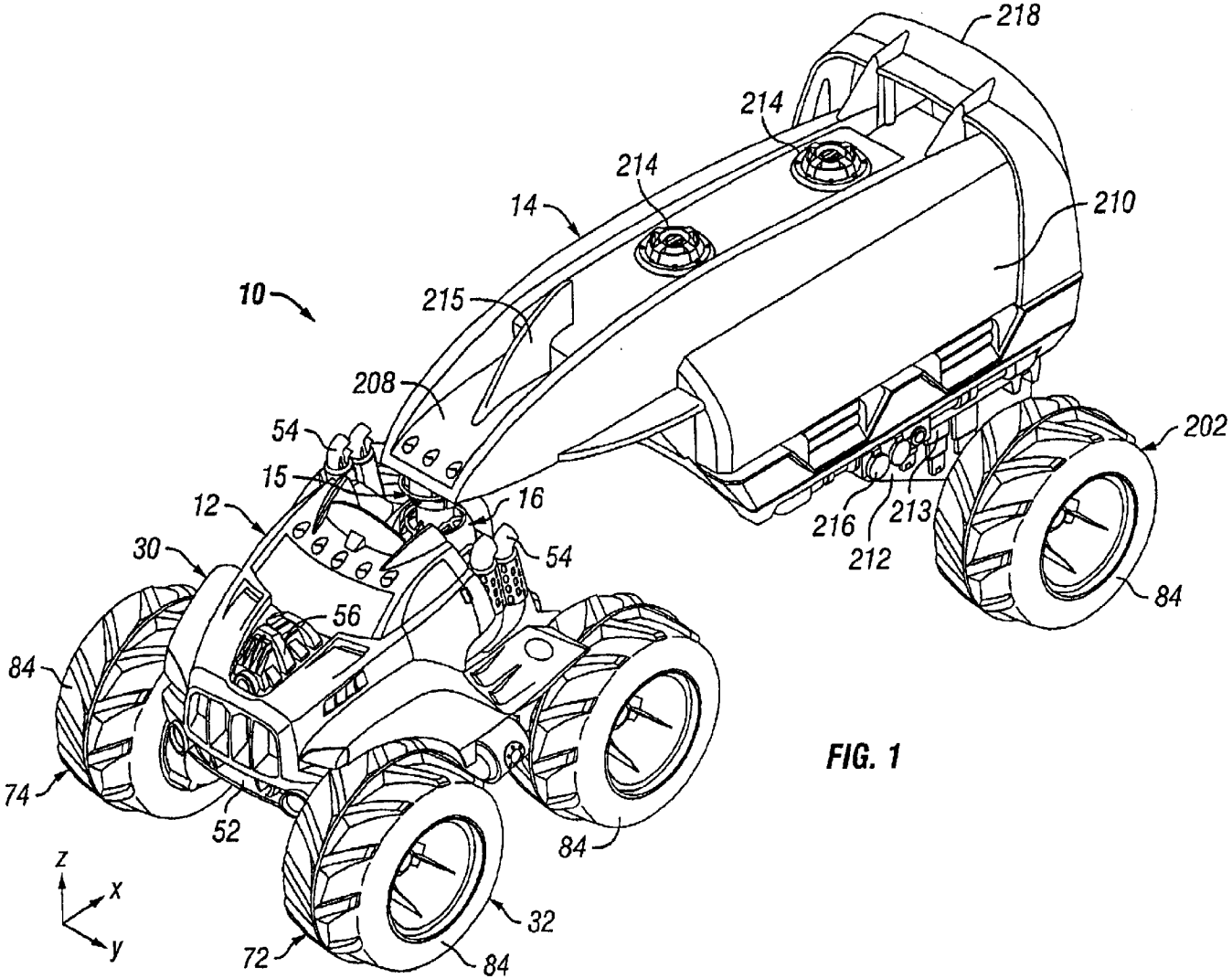
FIG. 1 is a perspective view of a tractor trailer toy in accordance with an exemplary embodiment of the invention.
Figure 2:
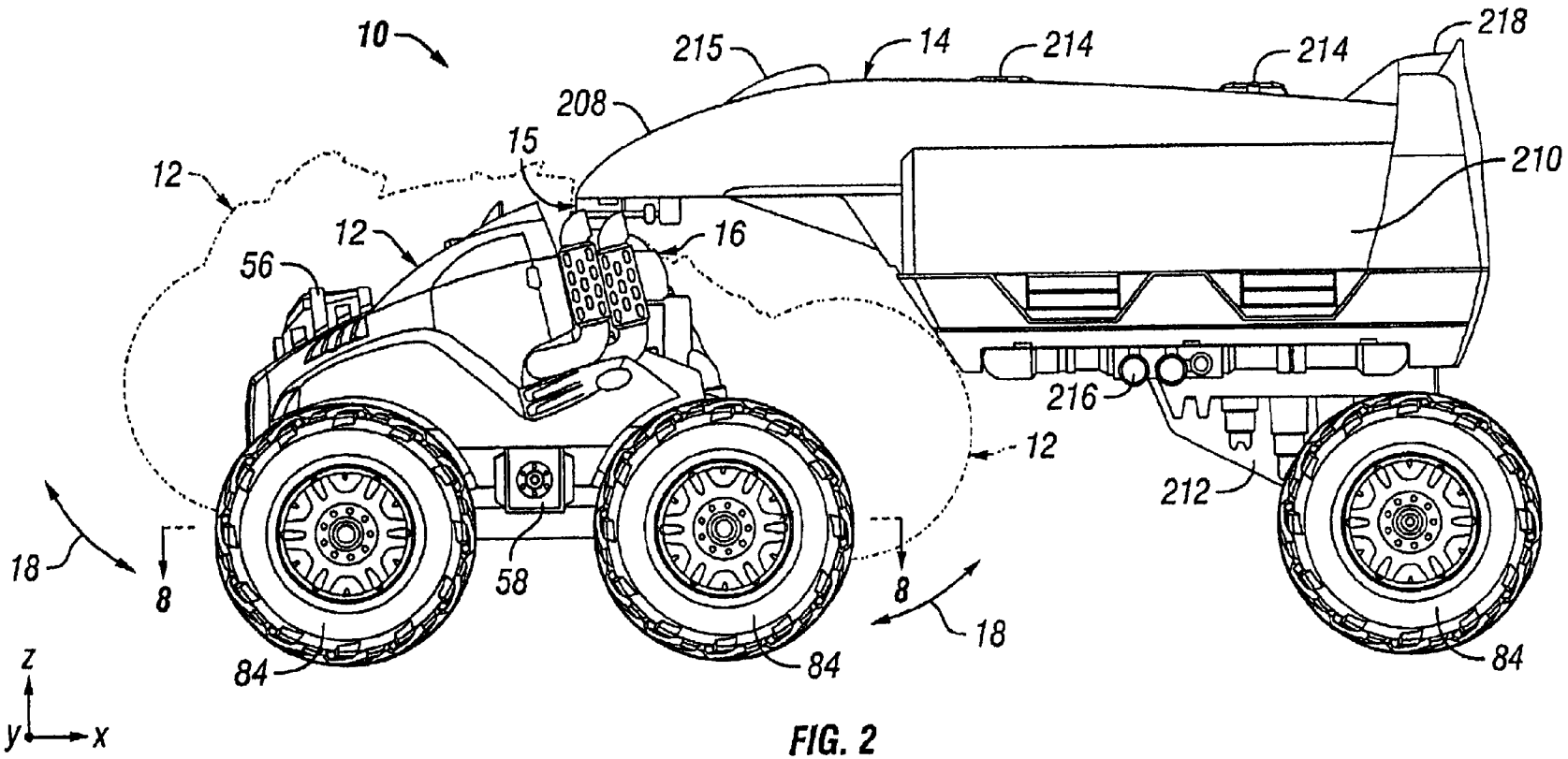
FIG. 2 is a side elevational view of the tractor trailer toy and illustrating relative tilt between the tractor and trailer about a lateral or Y-axis.
Figure 7A:
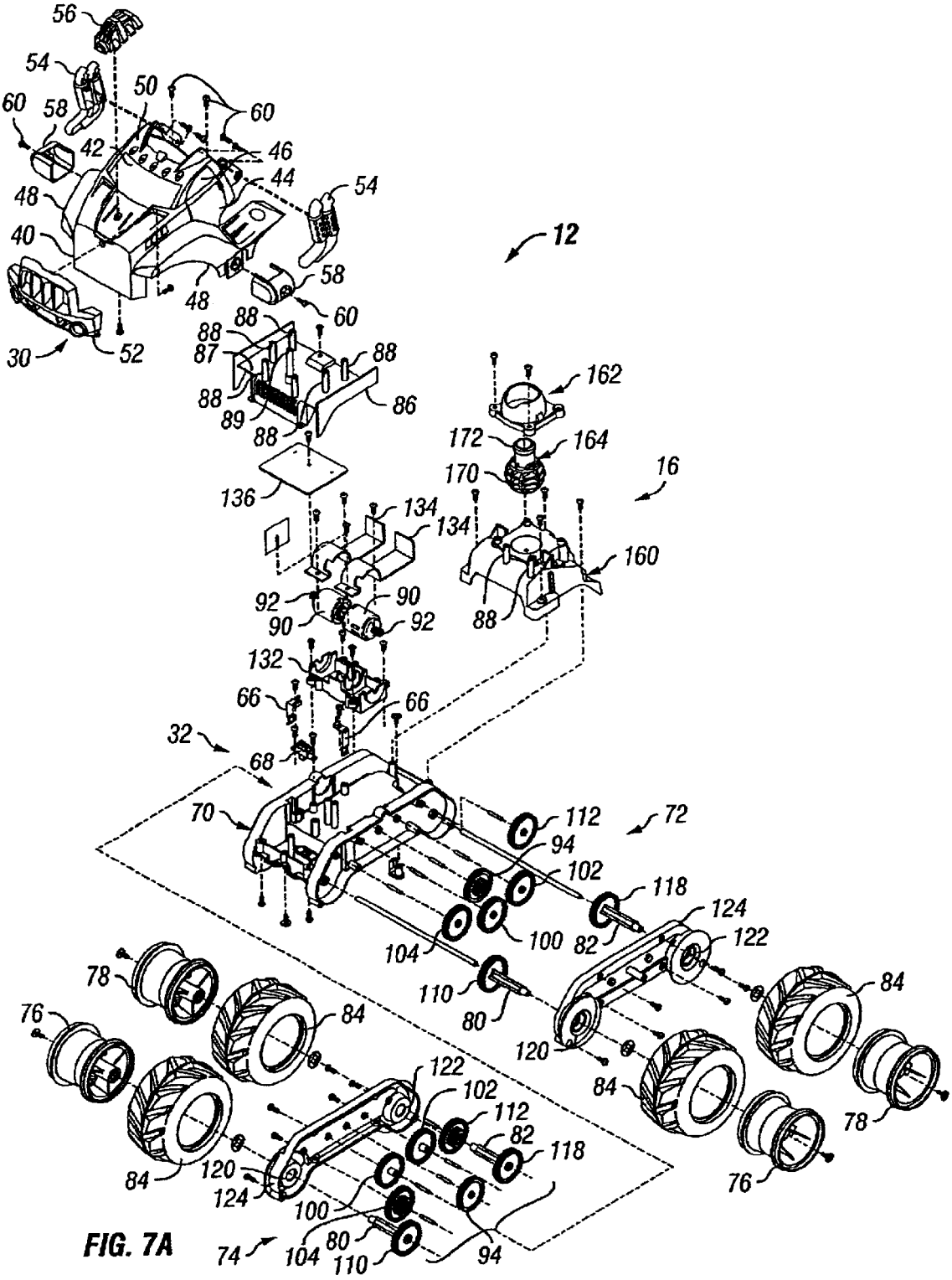
FIG. 7A is an exploded perspective view of the tractor.

With reference now to FIGS. 1 and 7A, the tractor 12 preferably includes a tractor body 30 and a tank-steering type operating assembly 32 preferably with independent left and right side wheel drives connected to the tractor body 30. The tractor hitch assembly 16 is shown mounted to the tractor operating assembly 32 but could be mounted to or part of the body 30.

The tractor body 30 has a main body portion 40 that is preferably shaped to include a windshield 42, doors 44 with side windows 46, fenders 48, lights 50, and other features typically associated with the bodies of heavy-duty trucks or tractors. Various accessory items can be molded separately and attached at appropriate locations to the main body portion 40, such as a front grill 52, smokestacks 54, an intake manifold 56, and fuel tanks 58. Preferably, the accessory items are connected to the main body portion 40 or operating assembly 32 through fasteners 60, such as screws, but other fastening means such as rivets, adhesives, ultrasonic welding, heat staking, and so on, can be used. Alternatively, the accessory items can be directly molded with the main body portion 40 or operating assembly 32. It will be understood that the tractor body can be formed of various shapes and styles, and is therefore not limited to the particular configuration shown. The tractor body 30 is preferably connected to the tractor operating assembly 32 through suitable fasteners 60, some of which may extend through the accessory items and into the tractor body.

The tractor operating assembly 32 preferably includes a chassis 70 to which a driver (left) side drive train 72 and a passenger (right) side drive train 74 are mounted. Pairs of front and rear road wheels 76, 78 are connected to front and rear output shafts 80, 82, respectively, of each drive train 72, 74. A tire 84, preferably constructed of rubber or a suitable resilient or elastomeric material, is mounted on each of the wheels 76, 78

Figure 6:
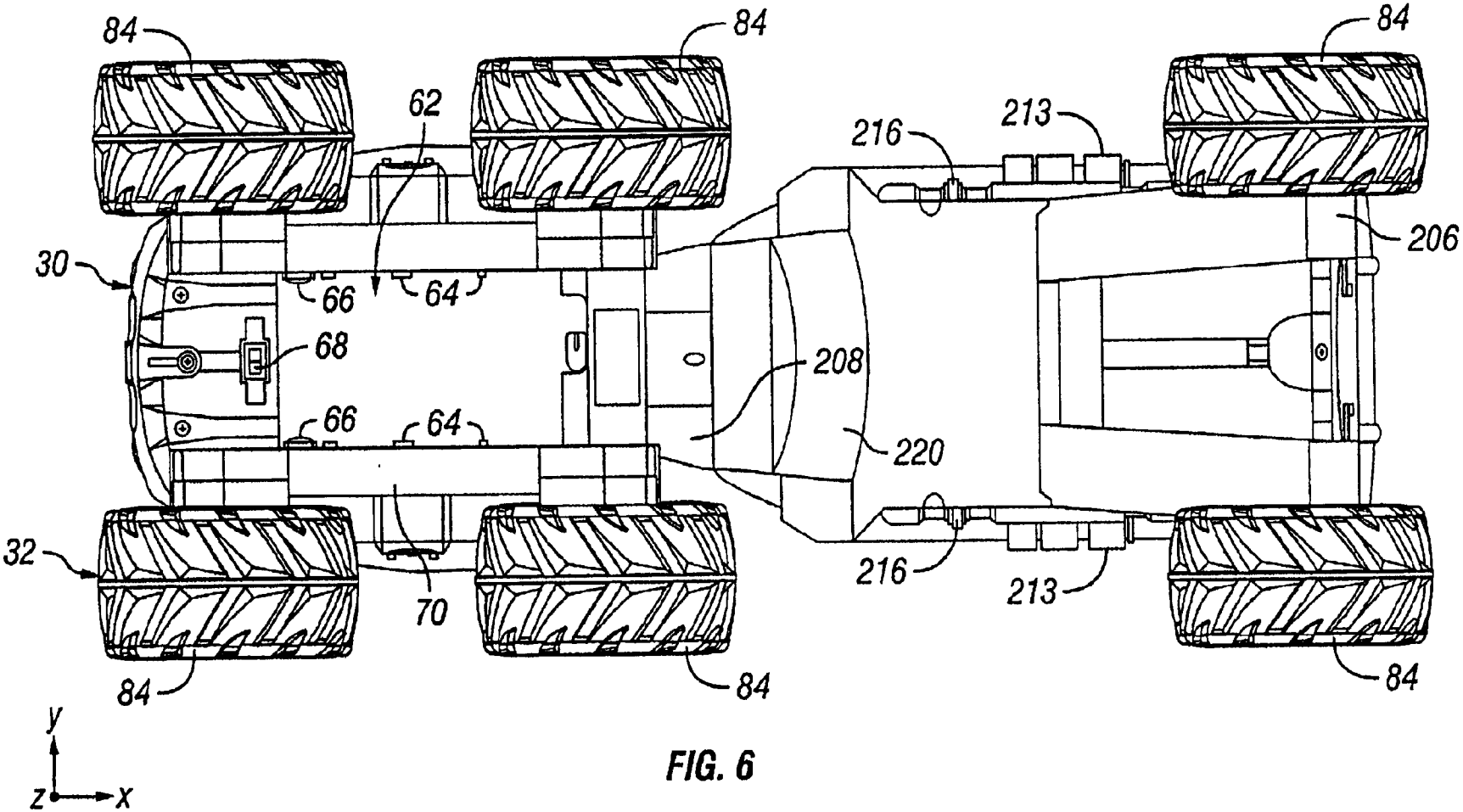
FIG. 6 is a bottom plan view of the tractor trailer toy.

As best shown in FIG. 6, a bottom of the chassis 70 includes a compartment 62 for receiving one or more batteries (not shown). Preferably, a plurality of tabs 64 extend into the compartment to engage a corresponding number of grooves (not shown) in the battery for locking the battery to the tractor 12. Electrical contacts 66 also preferably extend into the compartment 62 for engaging corresponding contacts (not shown) on the battery. An electrical switch 68, preferably in the form of a slide switch, is located adjacent the compartment 62 for selectively supplying electrical power to the tractor operating assembly 32 from the battery.

With reference again to FIG. 7A, preferably an antenna mounting bracket 86 is positioned between the main body portion 40 of the tractor body 30 and the chassis 70, and is connected to the chassis 70 through suitable fasteners 60 or other fastening means. The antenna mounting bracket 86 includes a plate 87 and a plurality of posts 88 extending upwardly therefrom. A slot 89 is formed in the upper end of each post for receiving and holding a wire antenna (not shown). In this manner, the antenna can be looped between the posts and thus mounted completely inside the tractor 12 away from view and access of the operator. Accordingly, antenna breakage and other problems that may occur with an exposed antenna are eliminated.

Figure 8:
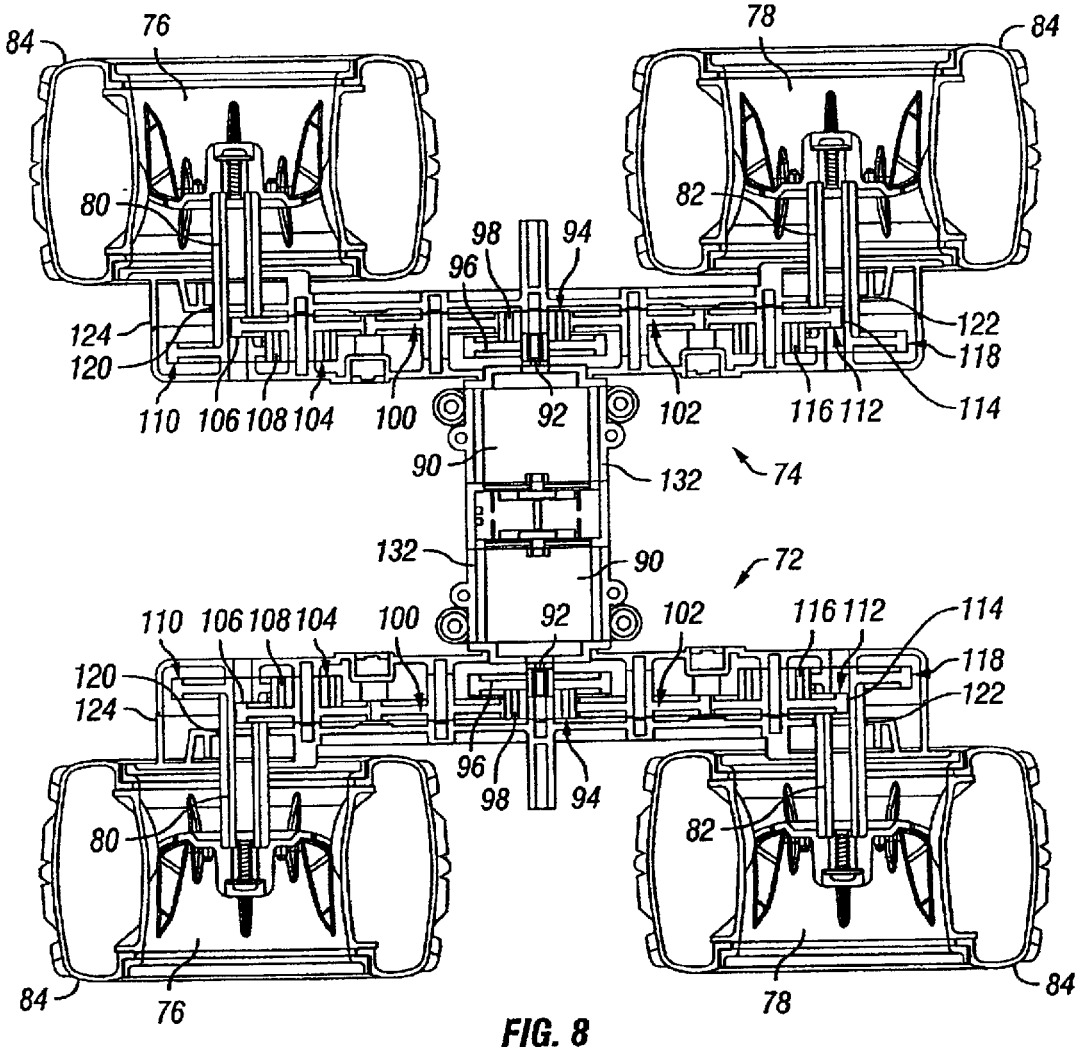
FIG. 8 is a sectional view of a tractor operating assembly taken along line 8—8 of FIG. 2.
Figure 9:
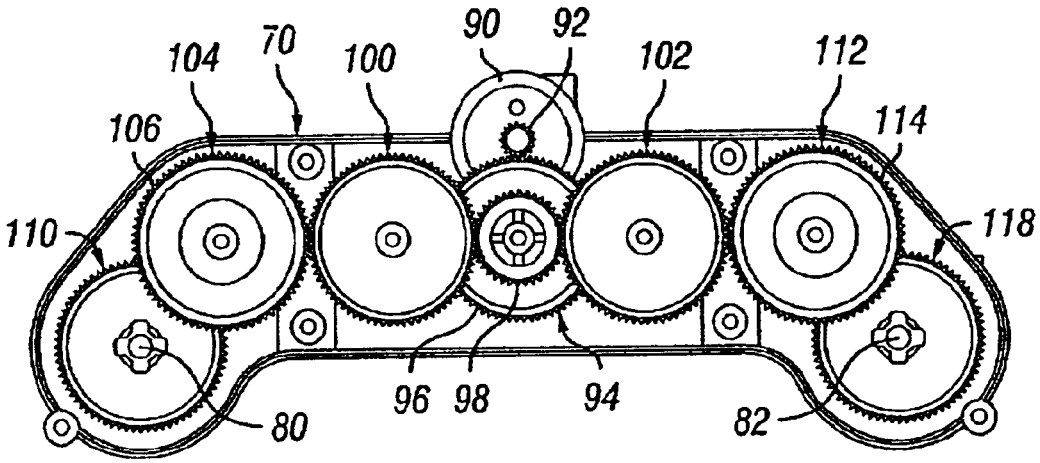
FIG. 9 is a side elevational view of the tractor operating assembly.

With reference now to FIGS. 7A, 8 and 9, the drive trains 72, 74 are preferably identical in construction, and therefore only the drive train 72 will be described. The drive train 72 includes an electric motor 90 with a geared shaft 92. A middle compound gear 94 has an outer gear 96 that meshes with the geared shaft 92 and an inner gear 98 that meshes with a forward spur gear 100 and a rearward spur gear 102. A forward compound gear 104 has an outer gear 106 that meshes with the forward spur gear 100 and an inner gear 108 that meshes with a forward drive gear 110 that includes the front output shaft 80. Likewise, a rearward compound gear 112 has an outer gear 114 that meshes with the rearward spur gear 102 and an inner gear 116 that meshes with a rearward drive gear 118 that includes the rear output shaft 82. The front and rear output shafts 80 and 82 extend through front and rear openings 120 and 122, respectively, of a drive train side cover 124. The drive train side covers 124 are preferably connected to the chassis 70 through suitable fasteners 60 or other fastening means.

The electric motors 90 are secured to the chassis 70 through a lower motor bracket portion 132 and upper motor bracket portions 134 that preferably encompass the motors. The lower and upper motor bracket portions are preferably secured to the chassis 70 through suitable fasteners 60 or other fastening means. A circuit board 136 is also mounted on the chassis 70 and includes conventional circuitry (not shown) for receiving control signals, preferably wireless radio control signals, from a hand-held remote control unit 140 (FIG. 14) to independently control operation of each motor 90, and thus each drive train 72 and 74 on the opposite lateral sides of the tractor 12, based on the received signals to thereby steer the tractor 12 and/or trailer 14.

Although the drive train assemblies are preferably driven by electric motors, it will be understood that one or more of the electric motors can be replaced by other well-known drive devices, such as fuel-powered motors, wind-up spring motors, flywheels, fluid pressure motors, and so on.

Figure 14:
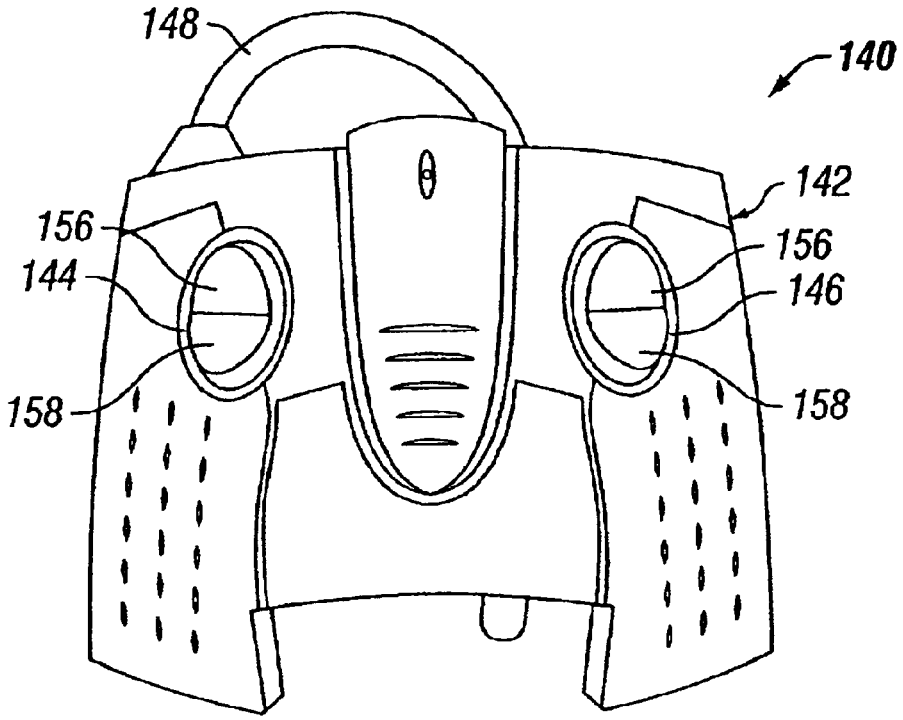
FIG. 14 is a top plan view of a hand held remote control unit for use with the tractor trailer toy.
Figure 15:
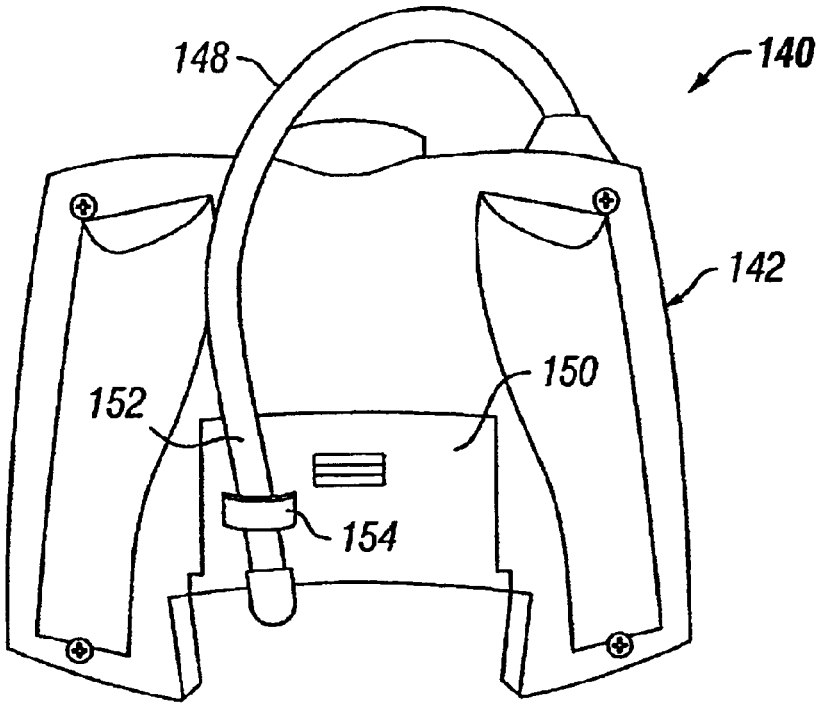
FIG. 15 is a bottom plan view of the remote control unit.

As shown in FIGS. 14 and 15, the remote control unit 140 comprises a housing 142 with a driver side control button 144 for operating the driver side drive train 72 and a passenger side control button 146 for operating the passenger side drive train 74. An antenna 148 extends out of the housing 142 for communicating control signals, preferably by radio wave, from the control buttons 144 and 146 to the circuit board 136 (FIG. 7A). It will be understood that the control unit can alternatively transmit signals to the tractor 12 via light (e.g. infrared), sound (e.g. ultrasound), direct electrical connection to the circuit board 136 through electrical wires, or other signal transmitting means. A cover 150 is removable from the housing 142 for gaining access to a battery compartment (not shown). A distal end 152 of the antenna 148 preferably extends through a loop 154 formed on the cover 150. Preferably, each control button 144, 146 comprises a rocker switch that is biased in a center "off" position and is movable toward either a forward tilt position by pressing the surface 156 or a rearward tilt position by pressing the surface 158.

In operation, and with reference to FIGS. 7A, 9 and 14, when the control button 144 is pressed toward the forward tilt position, a control signal is sent to the circuit board 136 of the tractor 12 to rotate the motor 90 of the driver side drive train 72 in a counterclockwise direction, as viewed in FIG. 9, and thereby simultaneously rotate the front and rear wheels 76 and 78, respectively, in the counterclockwise direction through the gears 92, 94, 100, 102, 104, 110, 112, and 118. In this manner, the driver side of the vehicle can be propelled forwardly. Likewise, when the control button 144 is pressed toward the rearward tilt position, a control signal is sent to the circuit board 136 to thereby rotate the motor 90 of the driver side drive train 72 in a clockwise direction, as viewed in FIG. 9, to thereby simultaneously rotate the front and rear wheels 76 and 78 in the clockwise direction, thus propelling the driver side of the vehicle rearwardly. It will be understood that the control button 146 and the passenger side drive train 74 operate in a similar manner With the above-described arrangement, and by way of example, the tractor 12, and trailer if attached, can be propelled in a substantially straight, forward direction by simultaneously pressing the control buttons 144 and 146 toward the forward tilt position. Likewise, the tractor 12 can be propelled in a substantially straight, rearward direction by simultaneously pressing the control buttons toward the rearward tilt position. The tractor 12 can be turned to the left or right by releasing one of the control buttons. In addition, the tractor 12 can be rotated in place 360° about a Z-axis to achieve or approximate a zero-radius turn, at least on a flat surface, by pressing the control buttons toward opposite tilt position positions, such that one drive train moves the tractor forwardly and the other drive train moves the tractor rearwardly.

When the trailer is attached to the tractor, the tractor is capable of steering under and preferably capable of rotating completely under the trailer, as will be described in greater detail below. In this manner, a wide variety of movement and stunts can be realized through only a pair of rocker switches. It will be understood that the rocker switches can be replaced by joysticks, separate forward and reverse control buttons, or other means for controlling operation of the drivetrans.

Preferably, the tractor body 30, including accessories such as the intake manifold 56, are shaped such that at least one tire 84 contacts the ground should a tractor rollover occur to thereby upright the tractor through manipulation of the control buttons without the necessity of physically contacting the toy by an operator.

Figure 10:
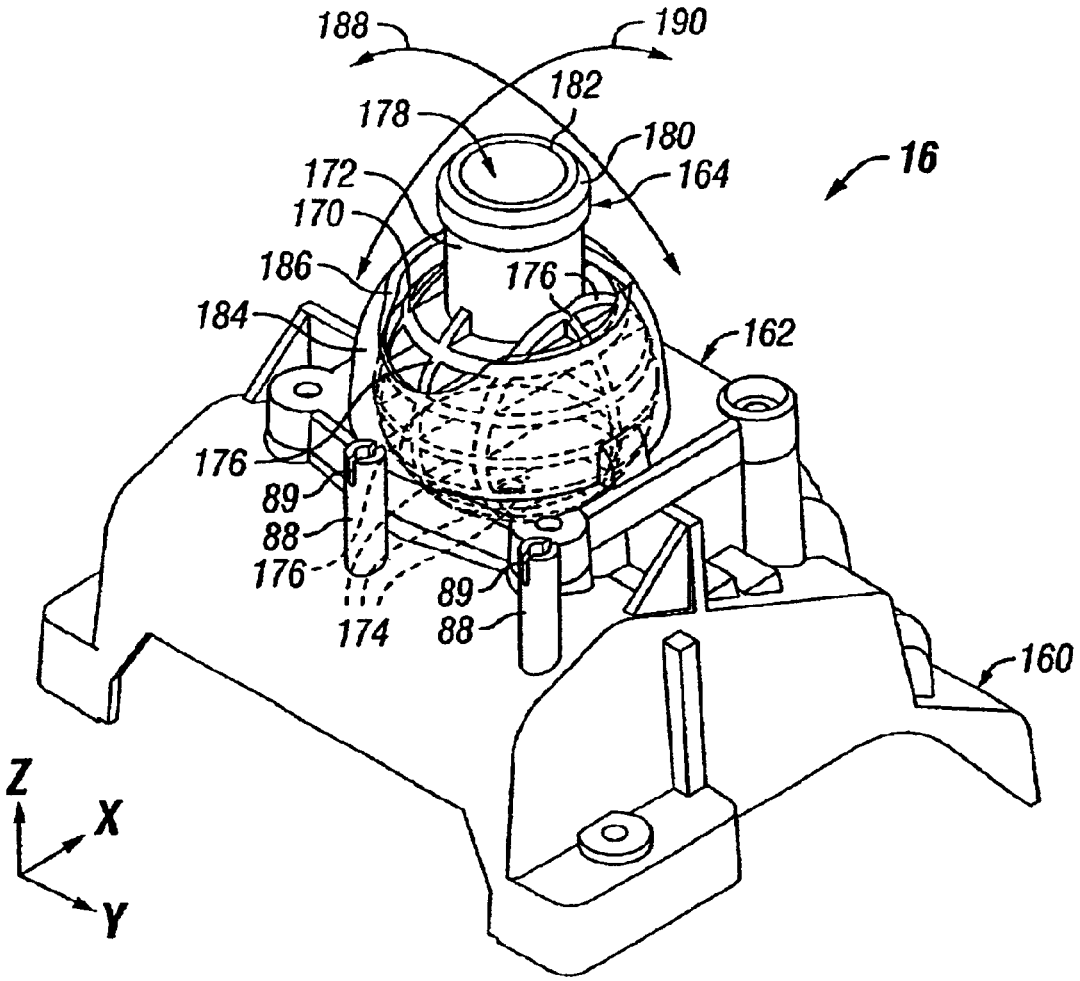
FIG. 10 is a perspective view of a tractor hitch assembly in accordance with the invention.
Figure 11:
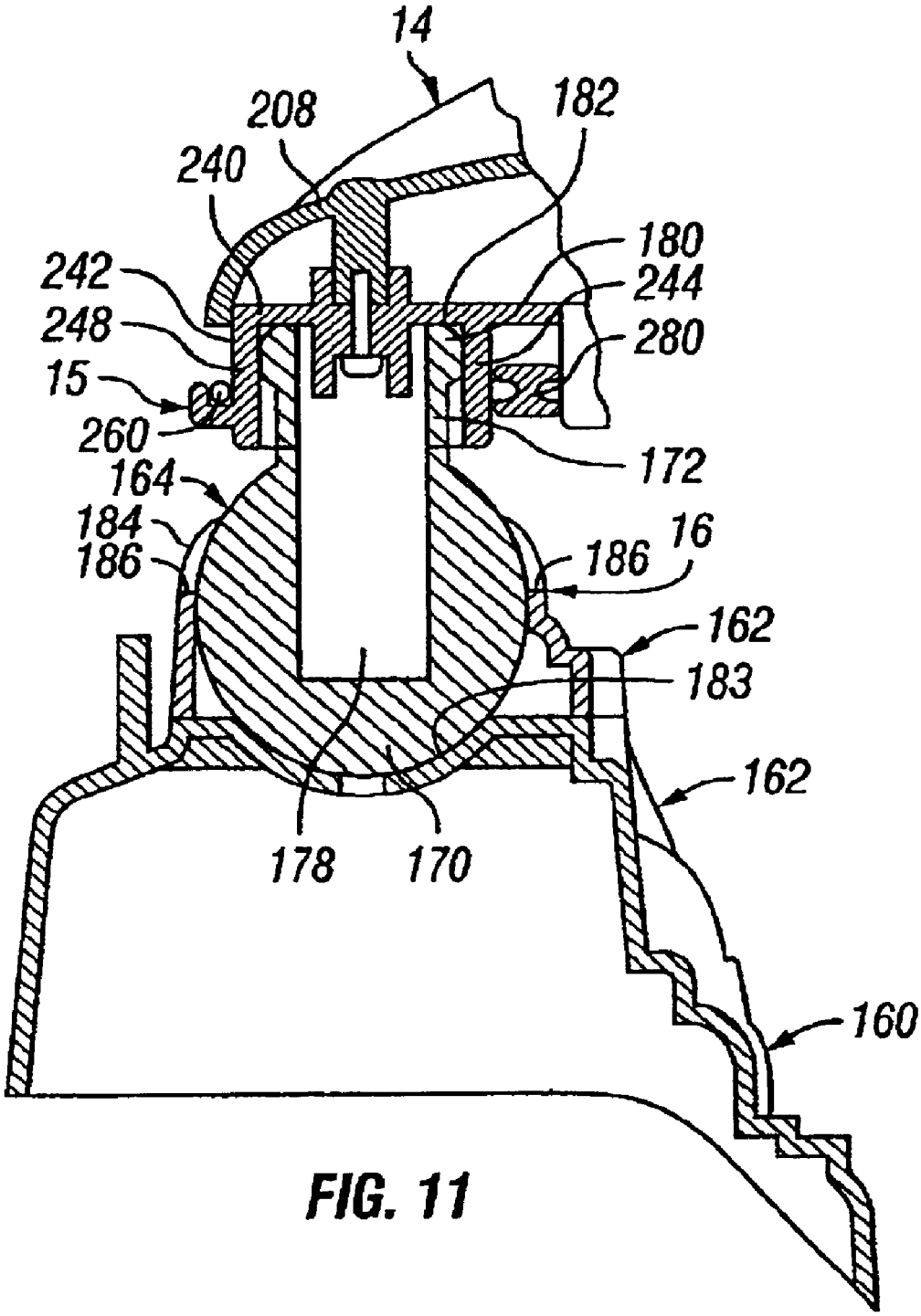
FIG. 11 is a sectional view of the tractor and trailer hitch assemblies taken along line 11—11 of FIG. 5.

Referring now to FIGS. 7A, 10 and 11, the tractor hitch assembly 16 preferably comprises a ball and socket type of articulated joint and includes a lower housing portion 160 that is preferably mounted to the chassis 70, an upper housing portion 162 and a tractor hitch portion 164. Upper portion 162 is preferably mounted to the lower housing portion 160 and forms a socket with the lower housing portion 160.

The tractor hitch portion 164 preferably includes a generally spherical or ball-shaped base 170 and a generally cylindrically-shaped connector member or arm 172 extending from the spherical base. As shown, the base 170 can be formed with a plurality of ribs 176 and pockets 174 located between the ribs. The pockets 174 reduce the amount of material and thus the weight of the base 170. As shown most clearly in FIG. 11, a bore 178 preferably extends through the connector member 172 and a substantial portion of the base 170. A rim 180 is preferably formed adjacent an upper edge 182 of the connector member or arm 172, the purpose of which will be described below.

The lower housing portion 160 has an upper surface 183 that is preferably semispherical in shape. Likewise, the upper housing portion 162 has a wall 184 that is preferably semi-spherical in shape. The upper surface 183 and the wall 184 together form a ball joint or socket into which the ball-shaped base 170 is rotatably received. Preferably, the wall 184 has an opening with a peripheral edge 186 through which the connector member 172 extends for coupling with the trailer hitch assembly 15. The peripheral edge 186 is preferably shaped to permit limited pivotal movement of the connector member 172 about the X-axis and the Y-axis, as represented by direction arrows 188 and 190, respectively, or combinations thereof, and thus relative pitch and roll between the tractor 12 and trailer 14. Preferably, the peripheral edge is shaped so that the amount of tilt of the connector member 172 about the X-axis is less than the amount of tilt about the Y-axis to prevent interference between the tractor 12 and trailer 14 during movement on uneven surfaces. The tractor hitch portion 164 is also able to rotate 360° about the Z-axis when the tractor and trailer are on a flat surface and, to a limited extent, about different combinations of the X-, Y- and Z-axes when the tractor and trailer are on uneven surfaces. In this manner, the tractor and trailer combination can perform a wide variety of movements and stunts over flat and uneven surfaces.

Figure 7B:
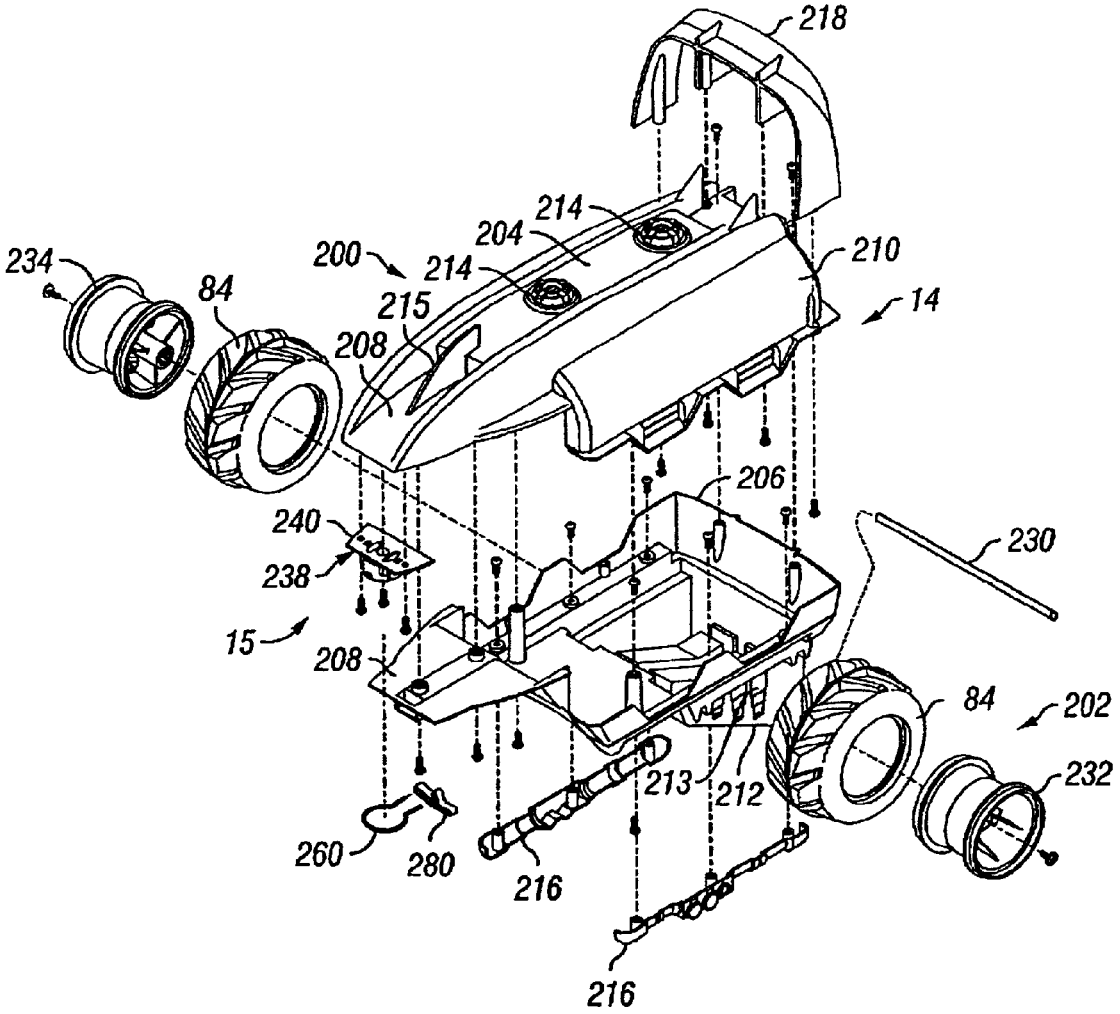
FIG. 7B is an exploded perspective view of the trailer.

With reference now to FIG. 7B, the trailer 14 preferably includes a trailer body 200, a trailer wheel assembly 202 connected to the trailer body 200, and the trailer hitch assembly 15 mounted to the trailer body 200.

The trailer body 200 has an upper trailer body portion 204 that is connected to a lower trailer body portion 206 through suitable fasteners 60, such as screws, but other fastening means such as rivets, adhesives, ultrasonic welding, heat staking, and so on, can be used. The upper and lower trailer body portions 204, 206 are preferably shaped to include features typically associated with heavy-duty trailers, such as a tongue 208, representative tank segments 210, and representative access ports 214. Wheel support segments 212 preferably extend downwardly from opposite sides of the lower trailer body portion 206 for mounting the wheel assembly thereto. Representative suspension elements 213 may be molded into the wheel support segments as shown. A protrusion 215 preferably extends upwardly from the tongue 208 to encourage movement of the trailer toward one of its sides in the event of a rollover to thereby facilitate uprighting the tractor trailer toy 10 during operation of the remote control unit 140 without the necessity of physically contacting the toy 10 by an operator.

Various accessory items can be molded separately and attached at appropriate locations to the trailer body portions 204 and 206, such as representative tank gauge elements 216 and a rear spoiler 218. Preferably, the rear spoiler 218 is sized, shaped and positioned on the trailer body to act as a roll bar, causing the entire vehicle to roll onto its sides when rolling over so that at least one of the driven wheels of the tractor will be is some contact with the surface supporting the vehicle 10 so that the contacting wheel(s) can be driven to cause the vehicle to right itself. To that end the wheels 72, 74 of the tractor 12 and 202 of the trailer 14 extend laterally outwardly beyond any other portion of the tractor 12 and trailer 14 and the weight of the vehicle 10 is concentrated in the lower halves of the tractor and trailer to further tend to cause the vehicle to come to rest at least on the side(s) of some of its driven wheels 72, 74. The spoiler 218 can also be made sturdy enough to double as a carrying handle. It further will be appreciated that the trailer can alternatively be provided with almost any sort of a raised protrusion along or near its longitudinal centerline which is size and shaped to eliminate any flat upper surface to the trailer which would allow the vehicle to lie in a stable condition on its top. It will further be appreciated that the tractor 12 can also be provided with a dome-like or cylindrical shape or other centrally located protrusion(s) to the top of its body to prevent the tractor from coming to rest upside down on the top of its body, with or without the trailer, tend to make it roll at least onto the side of one of its driven wheels. Preferably, the accessory items are connected to their respective trailer body portions through fasteners 60, such as screws, or other fastening means. Alternatively, the accessory items can be directly molded with their respective trailer body portions. It will be understood that the trailer body 200 can be formed of various shapes and styles, and is therefore not limited to the particular configuration shown.

As best shown in FIG. 6, the lower trailer body portion has a curved front wall 220 with a sufficient radius or depth that, in combination with the tongue 208 and location of the hitch on the tongue, provides sufficient clearance for the tractor 12 to rotate about the Z-axis at least on a level surface supporting the toy vehicle without any interference with the trailer 14.

Referring again to FIG. 7B, the trailer wheel assembly 202 includes a shaft or axle 230 that extends through the support segments 212, a driver side road wheel 232 and a passenger side road wheel 234 preferably mounted for rotation at opposite ends of the axle 230, and a tire 84 mounted on each wheel. Although only a single axle is shown, it will be understood that more axles and/or more wheels may be provided.

With additional reference to FIGS. 11, 12, 13A and 13B, the trailer hitch assembly 15 comprises a trailer hitch portion 238 (FIG. 7B) with a mounting plate 240 that is attached to the tongue 208 of the trailer upper body portion 204 through suitable fasteners 60 or other fastening means, and a trailer connector member 242 that extends downwardly from the plate 240. The trailer connector member 242 is preferably of generally hollow cylindrical configuration to thereby form a receptacle into which the tractor connector member 172 is received. Preferably, the trailer connector member 242 is integrally formed with the mounting plate 240 and is divided into four segments 244, 246, 248 and 250. The segments 246 and 250 are separated from the segments 244 and 248 by L-shaped slots 252 that extend through the connector member 242 and into the mounting plate 240. The slots 252 permit limited movement of the segments 246 and 250 away from and toward an axial center of the trailer connector member 242 under bias forces exerted by the material of the mounting plate 240 adjacent the slots 252 during insertion of the tractor connector member 172.

Figure 12:
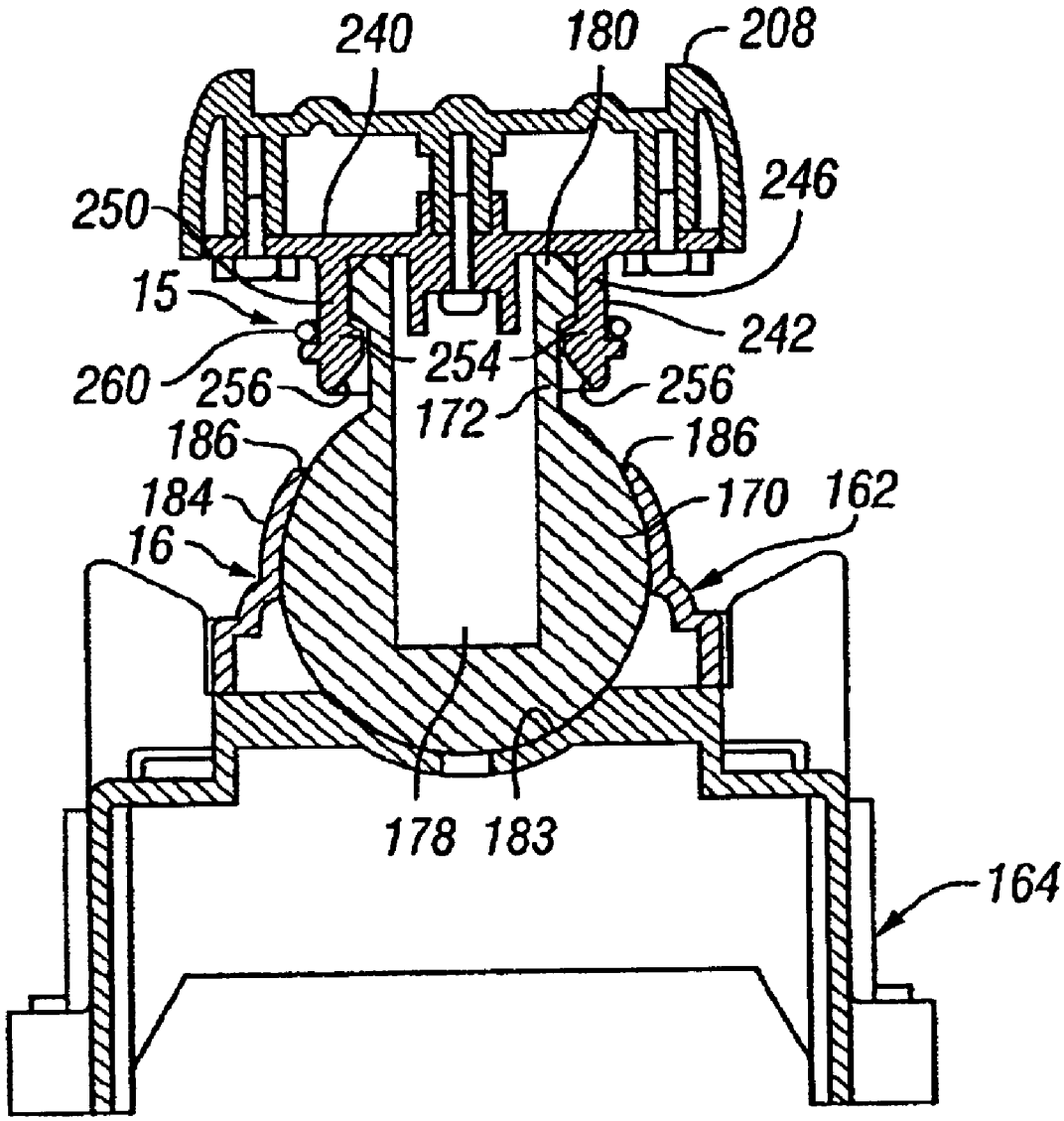
FIG. 12 is a sectional view of the tractor and trailer hitch assemblies taken along line 12—12 of FIG. 5.

As best shown in FIG. 12, inwardly extending tabs 254 are formed on the segments 246 and 250 for engaging the rim 180 of the tractor connector member 172 when the tractor connector member is fully inserted into the trailer connector member 242. A tapered lower surface 256 of each tab 254 facilitates insertion of the rim 180 into the trailer connector member 242.

Figure 13A:
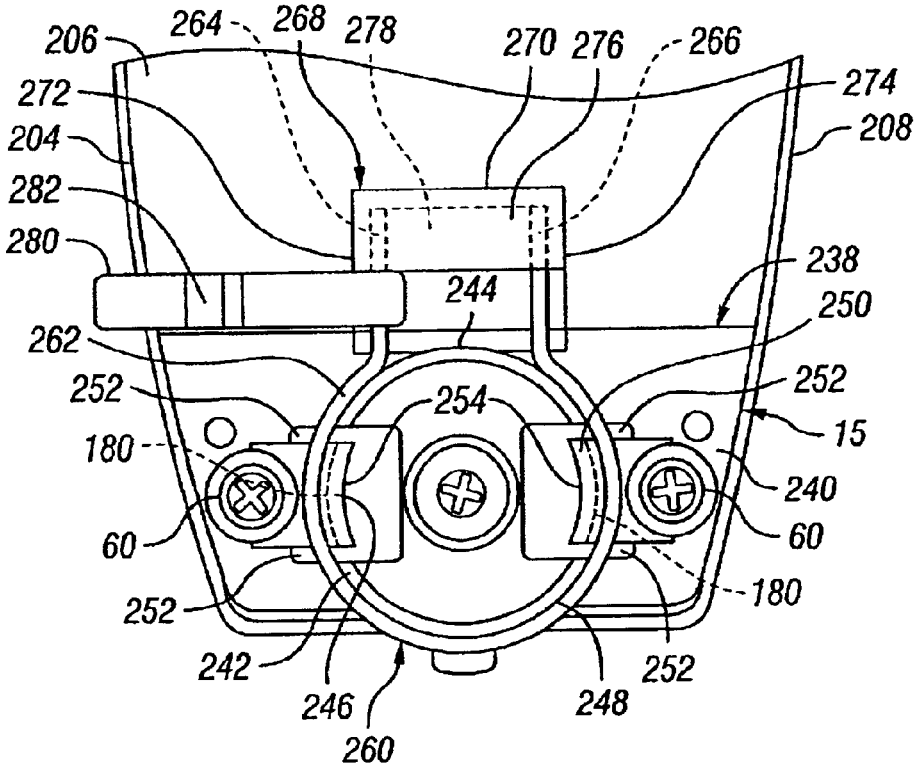
FIG. 13A is bottom plan view of the trailer hitch assembly in an unlocked position.
Figure 13B:
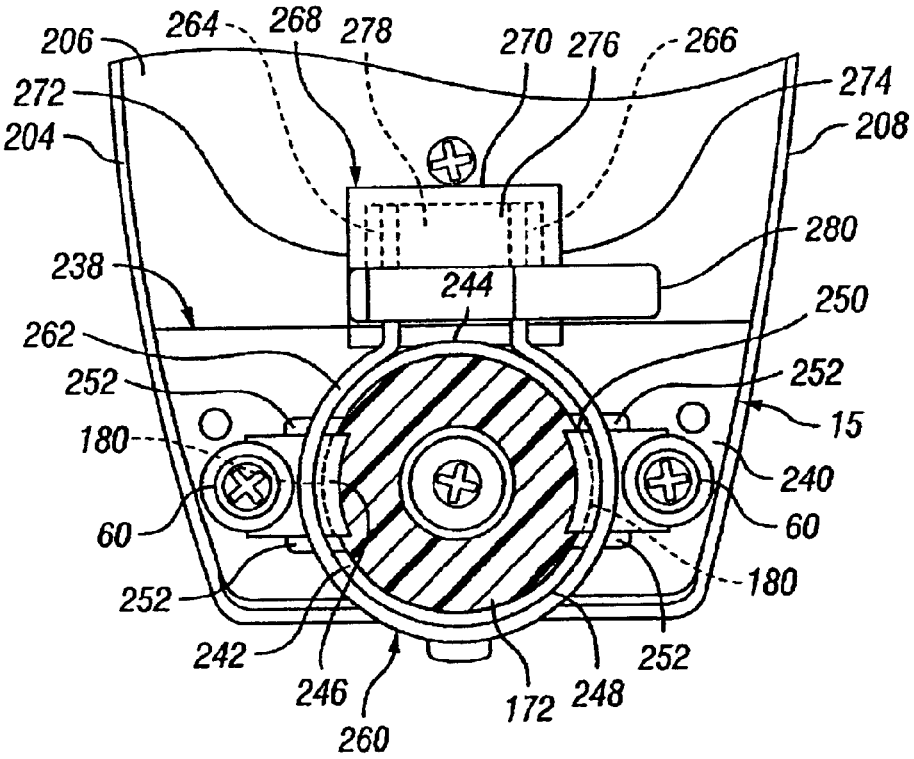
FIG. 13B is a bottom plan view of the trailer hitch assembly in a locked position with a portion of the tractor hitch assembly shown in cross section.

Referring to FIGS. 13 and 13A, the trailer hitch assembly 15 further comprises a lock ring 260 with a ring portion 262 that preferably substantially encircles the trailer connector member and leg portions 264 and 266 that extend from opposite ends of the ring portion and into a retainer 268. The retainer 268 is preferably integrally formed with the tongue 208 of the lower body portion 206 and extends downwardly therefrom. The retainer 268 preferably includes a rear wall 270, spaced side walls 272 and 274 extending forwardly of the rear wall, and a bottom wall 276 extending between the side walls and rear wall to thereby form a recess 278 into which the leg portions 264 and 266 extend. As shown in FIG. 13A, the leg portions 264 and 266 are positioned in the recess adjacent the side walls 272 and 274, respectively, when the lock ring is in an unlocked position. A locking arm 280 is preferably pivotally connected to the leg portion 264 and is rotatable toward the leg portion 266. A hook 282 is formed on the locking arm 280 and is shaped to engage the leg portion 266 and squeeze the leg portions toward each other as the locking arm 280 is rotated toward the leg 266 to thereby compress the ring portion 262. Once the locking arm is completely rotated to its locked position, as shown in FIG. 13B, the hook 282 is in an over-center position with respect to the leg portions 264 and 266 to thereby lock the ring portion 252 in the compressed position. As the ring portion 252 is compressed, the segments 246 and 250 of the trailer connector member 242 are prevented from deflecting outwardly with the tabs 254 positioned over the rim 180 of the tractor connector member 172 to thereby prevent separation of the trailer connector member 242 from the tractor connector member 172. In the locked position, it is preferable, although not necessary, for the tabs 254 to frictionally grip the sides of the tractor connector member 172. The tractor connector member can be released from the trailer connector member by disengaging the hook 282 of the locking arm 280 from the leg portion 266, then pulling the tractor connector member free from the trailer connector member.

Since the base member 170 of the tractor hitch assembly 16 is freely rotatable in the socket of the trailer hitch assembly 15, it is not necessary for the tractor connector member 172 and trailer connector member 242 to be of generally hollow cylindrical shape as shown and described. Thus, it will be understood that the connector members can have various cross sectional shapes, such as square, rectangular, triangular, octagonal, and so on.

It will be appreciated by those skilled in the art that changes could be made to the embodiments described above without departing from the broad inventive concept thereof. It will be appreciated that although the tractor hitch portion 164 is essentially a ball with an arm or pin that could have been more permanently attached to the trailer and releasably received on the chassis (or body) to permit separation of the element 164 from the tractor 12. Furthermore, although a ball joint articulated coupling is preferred, a conventional tractor trailer, fifth wheel coupling could be provided with a shoe on the back of the tractor pivoting upon a horizontal transverse axis and a pin extending downwardly from a tongue of the trailer into a bore in the top of the shoe. The shoe would have to be raised higher than normal on the back of the tractor or an unusually elongated pin extended downward, or a combination of these two revisions made to a standard fifth wheel type articulated coupling to provide the necessary clearance beneath the trailer. Also, while the tractor 12 described as capable of essentially turning in position with a zero turning radius, the invention is intended to cover more conventional toy vehicle having greater than a zero radius turning capability and indeed is intended to cover toy vehicles with conventional toy vehicle steering whereby, for example, the tractor can be turned and driven in reverse at the same time to eventually pass under the trailer without jackknifing the trailer. Also, while the invention has been described with respect to a powered, remotely-controlled toy vehicle, the couplings described above can be used with other toy vehicles including unpowered toy vehicles as well.

By way of further example, although the tractor hitch assembly 16 has been described and shown with the bali and socket arrangement, it will be understood that the trailer hitch assembly 15 could alternatively be provided with such. Moreover, although the drive train assemblies have been shown and described with two pairs of drive wheels, it will be understood that more or less drive wheels can be provided. It will be further understood that the tractor operating assembly can be replaced by separate steering and drive mechanisms. By way of example, the structure and manner in which the tractor is turned can be replaced by other steering mechanisms, such as counter-turning front and rear wheels, a single pair of independently operable drive wheels on the tractor, or other steering means to achieve or approximate a zero-radius turn.

It should further be appreciated that the described preferred tractor 12 of the preferred embodiment vehicle 10 can easily pass beneath the preferred embodiment trailer 14 without contact of any kind, even when the toy vehicle is not on a level support surface, so much clearance being provided. However, the invention is intended to cover those toy vehicles capable of essentially performing the same maneuvers, at least on a level surface, even if there is some minor contact or interference of the tractor with the trailer in passing under the trailer as long as the tractor can pass under the trailer without jackknifing or turning over the trailer or lifting the trailer off all its road wheels. Of course, the greater clearance of the described preferred embodiment of the invention enables it to perform more stunts without disruption or interruption of its operation.

It will be understood, therefore, that this invention is not limited to the particular embodiments disclosed, but it is intended to cover modifications within the spirit and scope of the present invention as defined by the appended claims.

What is claimed is:

1. A toy vehicle comprising a tractor having a tractor body with a powered operating assembly configured to at least steer the tractor from a forward facing position to an opposite rearward facing position, and a tractor hitch assembly connected to at least one of the operating assembly and the body;

a trailer having a trailer body and a tongue extending therefrom, and a trailer hitch assembly connected to the trailer tongue and being countable with the tractor hitch assembly, the tractor and trailer being configured such that the tractor can steer at least from the forward facing position to the opposite rearward facing position and be longitudinally aligned under the trailer tongue at least essentially without interference with the trailer.

2. A toy vehicle according to claim 1, wherein one of the tractor and trailer hitch assemblies comprises:

a hitch portion having a base member and a first connector member extending from the base member; and a housing portion connected to one of the tractor and trailer, the housing portion having a socket for receiving the base member and an opening through which the first connector member extends for coupling with the other of the tractor and trailer hitch assemblies.

3. A toy vehicle according to claim 2, wherein the base member is pivotal in the socket about first and second mutually orthogonal axes to thereby enable pivoting movement between the tractor and trailer about the first and second axes, and is rotatable 360° at least about a third axis that is perpendicular to the first and second axes to thereby enable 360° rotation of the tractor at least about the third axis.

4. A toy vehicle according to claim 2, wherein the other of the tractor and trailer hitch assemblies comprises a second connector member with a receptacle into which the first connector member is received.

5. A toy vehicle according to claim 4, wherein a rim is located at a free end of the first connector member, and further wherein the second connector member has at least one resilient segment with a tab that projects into the receptacle, such that insertion of the first connector member into the second connector member causes outward deflection of the resilient segment, and thus movement of the tab from a rest position to a deflected position until the rim is free of the tab, whereupon the tab returns to the rest position to thereby releasably lock the first connector member to the second connector member.

6. A toy vehicle according to claim 5, and further comprising a lock ring extending around the second connector member, including the resilient segment, the lock ring being movable between an expanded position to thereby permit outward deflection of the resilient segment for separating the first and second connector members and a compressed position to thereby prevent outward deflection of the resilient segment for locking the first and second connector members together.

7. A toy vehicle according to claim 4, wherein a rim is located at a free end of the first connector member, and further wherein the second connector member has a pair of oppositely disposed resilient segments, each resilient segment including a tab that projects into the receptacle, such that insertion of the first connector member into the second connector member causes outward deflection of the resilient segments, and thus movement of each tab from a rest position to a deflected position until the rim is free of each tab, whereupon each tab returns to the rest position to thereby releasably lock the first connector member to the second connector member.

8. A toy vehicle according to claim 7, and further comprising a lock ring extending around the second connector member, including the resilient segments, the lock ring being movable between an expanded position to thereby permit outward deflection of the resilient segments for separating the first and second connector members and a compressed position to thereby prevent outward deflection of the resilient segments for locking the first and second connector members together.

9. A toy vehicle according to claim 1, wherein the operating assembly comprises a chassis, a first set of longitudinally spaced wheels rotatably connected to one side of the chassis, a second set of longitudinally spaced wheels rotatably connected to an opposite side of the chassis, a first drive motor operably connected to the first set of wheels for simultaneously rotating the first set of wheels in at least one of forward and reverse directions, and a second drive motor operatively connected to the second set of wheels for simultaneously rotating the second set of wheels in at least one of forward and reverse directions to thereby move the tractor in at least one of the forward and reverse directions.

10. A toy vehicle according to claim 9, wherein the operating assembly further comprises circuitry for independently operating the first and second drive motors to control turning movement of the tractor.

11. A toy vehicle according to claim 10, wherein the operating assembly further comprises circuitry for independently operating the first and second drive motors such that movement of one of the first and second sets of wheels in the forward direction and movement of the other of the first and second sets of wheels in the reverse direction causes the tractor to turn in place.

12. A toy vehicle according to claim 11 wherein the tractor hitch assembly comprises a hitch portion having a base member and a first connector member extending from the base member, and a housing portion connected to the chassis, the housing portion having a socket for receiving the base member and an opening through which the first connector member extends for coupling with the trailer hitch assembly, the base member being pivotal in the socket about first and second mutually orthogonal axes and rotatable 360° at least about a third axis that is perpendicular to the first and second axes; and wherein the trailer hitch assembly comprises a second connector member with a receptacle into which the first connector member is received, the first and second connector members being countable to thereby enable pivoting movement between the tractor and trailer about the first and second axes and 360° rotation of the tractor at least about the third axis under the trailer tongue.

13. An articulated toy vehicle comprising:

a first vehicle portion having a first hitch connected thereto;

a second vehicle portion having a second hitch connected thereto;

wherein the first hitch comprises a base member and a first connector member extending from the base member, and a housing connected to the first vehicle portion, the housing having a socket for receiving the base member and an opening through which the first connector member extends for coupling with the second hitch; and wherein the base member is pivotal in the socket about first and second mutually orthogonal axes to thereby enable pivoting movement between the first and second vehicle portions about the first and second axes, and is rotatable 360° at least about a third axis that is perpendicular to the first and second axes to thereby enable 360° rotation of one of the first and second vehicle portions at least about the third axis.

14. An articulated toy vehicle comprising:

a first vehicle portion having a first hitch connected thereto;

second vehicle portion having a second hitch connected thereto;

wherein the first hitch comprises a base member and a first connector member extending from the base member, and a housing connected to the first vehicle portion, the housing having a socket for receiving the base member and an opening through which the first connector member extends for coupling with the second hitch;

wherein the second hitch comprises a second connector member with a receptacle into which the first connector member is received; and wherein a rim is located at a free end of the first connector member, and further wherein the second connector member has at least one resilient segment with a tab that projects into the receptacle, such that insertion of the first connector member into the second connector member causes outward deflection of the resilient segment, and thus movement of the tab from a rest position to a deflected position until the rim is free of the tab, whereupon the tab returns to the rest position to thereby releasably lock the first connector member to the second connector member.

15. An articulated toy vehicle according to claim 14, and further comprising a lock ring extending around the second connector member, including the resilient segment, the lock ring being movable between an expanded position to thereby permit outward deflection of the resilient segment for separating the first and second connector members and a compressed position to thereby prevent outward deflection of the resilient segment for locking the first and second connector members together.

16. An articulated toy vehicle comprising:

a first vehicle portion having a first hitch connected thereto;

a second vehicle portion having a second hitch connected thereto;

wherein the first hitch comprises a base member and a first connector member extending from the base member, and a housing connected to the first vehicle portion, the housing having a socket for receiving the base member and an opening through which the first connector member extends for coupling with the second hitch;

wherein the second hitch comprises a second connector member with a receptacle into which the first connector member is received; and wherein a rim is located at a free end of the first connector member, and further wherein the second connector member has a pair of oppositely disposed resilient segments, each resilient segment including a tab that projects into the receptacle, such that insertion of the first connector member into the second connector member causes outward deflection of the resilient segments, and thus movement of each tab from a rest position to a deflected position until the rim is free of each tab, whereupon each tab returns to the rest position to thereby releasably lock the first connector member to the second connector member.

17. An articulated toy vehicle according to claim 16, and further comprising a lock ring extending around the second connector member, including the resilient segments, the lock ring being movable between an expanded position to thereby permit outward deflection of the resilient segments for separating the first and second connector members and a compressed position to thereby prevent outward deflection of the resilient segments for locking the first and second connector members together.

18. An articulated toy vehicle comprising:

a first vehicle portion having a plurality of road wheels;

a second vehicle portion having a plurality of road wheels; and an articulated coupling between the first vehicle portion and the second vehicle portion;

the first and second vehicle portions and the articulated coupling being configured and positioned such that the first vehicle portion can be rotated at least 360° around the articulated coupling and completely beneath the second vehicle portion at least essentially without interference between the first and second vehicle portions with all of the road wheels of the first and second vehicle portions supported by a level surface beneath the vehicle.

19. The articulated toy vehicle of claim 18 further comprises:

at least one motor drivingly coupled with at least one of the road wheels of one of the first and second vehicle portions; and circuitry configured to receive wireless control signals from a remote unit and to control operation of the at least one motor to propel the vehicle.

20. The articulated toy vehicle of claim 19 wherein the one vehicle portion includes at least a second motor drivingly coupled to at least one other of the road wheels of the one vehicle portion, the at least one road wheel and the at least one other road wheel being located on opposite lateral sides of the one vehicle portion.

21. The articulated toy vehicle of claim 20 wherein the circuitry is configured to control the one motor and the second motor independently of one another.

22. The articulated toy vehicle of claim 18 wherein at least one of the first and second vehicle portions has an upper side shaped to prevent the vehicle from coming to rest on the upper side should the vehicle rollover on a level support surface.

* * * * *